US005299900A

United States Patent [19]

Mailliet et al.

[11] Patent Number: 5,299,900

[45] Date of Patent: Apr. 5, 1994

[54] INSTALLATION FOR CHARGING A SHAFT FURNACE

[75] Inventors: Pierre Mailliet, Luxembourg; Emile Lonardi, Bascharage, both of Luxembourg

[73] Assignee: Paul Wurth S.A., Luxembourg, Luxembourg

[21] Appl. No.: 883,007

[22] Filed: May 14, 1992

[30] Foreign Application Priority Data

May 15, 1991 [LU] Luxembourg ..... 87938

[51] Int. Cl.[5] ..... F23K 3/18

[52] U.S. Cl. ..... 414/206; 193/17; 193/23; 266/199; 414/208

[58] Field of Search ..... 414/299, 302, 160, 208, 414/199-206, 588; 193/17, 23; 266/176, 197, 199

[56] References Cited

U.S. PATENT DOCUMENTS

| | | | |
|---|---|---|---|
| 3,693,812 | 9/1972 | Mahr et al. | 414/206 X |
| 3,814,403 | 6/1974 | Legille | 414/208 |
| 4,032,024 | 6/1977 | Genge et al. | 414/199 |
| 4,273,492 | 6/1981 | Legille et al. | 414/206 X |
| 4,306,827 | 12/1981 | Tsutsumi et al. | 414/160 |
| 4,360,305 | 11/1982 | Dorsch | 414/208 |
| 4,493,600 | 1/1985 | Legille et al. | 414/208 |
| 4,575,790 | 3/1986 | Legille et al. | 414/208 X |
| 4,755,095 | 7/1988 | Mailliet et al. | 414/200 |
| 4,941,792 | 7/1990 | Cimenti et al. | 414/208 |
| 5,022,806 | 6/1991 | Lonardi et al. | 414/208 |

FOREIGN PATENT DOCUMENTS

| | | | |
|---|---|---|---|
| 2657211 | 7/1978 | Fed. Rep. of Germany . | |
| 2634544 | 6/1989 | France . | |
| 2636726 | 9/1989 | France . | |
| 1527273 | 12/1989 | U.S.S.R. | 414/199 |
| 1678845 | 9/1991 | U.S.S.R. | 414/208 |

OTHER PUBLICATIONS

Soviet Inventions Illustrated, Section m24, week 9024, publie 25-07-90, Derwent Publs., London, gb.

*Primary Examiner*—David A. Bucci

*Attorney, Agent, or Firm*—Fishman, Dionne & Cantor

[57] ABSTRACT

An installation is proposed for charging a shaft furnace comprising a rotating and pivoting distribution chute. The chute is supported in a removable manner by two lateral side plates of a "U"-shaped stirrup piece. When a first ring securely fastened to a dome performs a relative movement with respect to a second ring, the dome, via an arm causes the stirrup piece to pivot about its horizontal axis which transmits this pivoting to the chute. The end of the arm pivots, to this end, in a runner block sliding in a groove of the dome.

6 Claims, 5 Drawing Sheets

Fig. 1
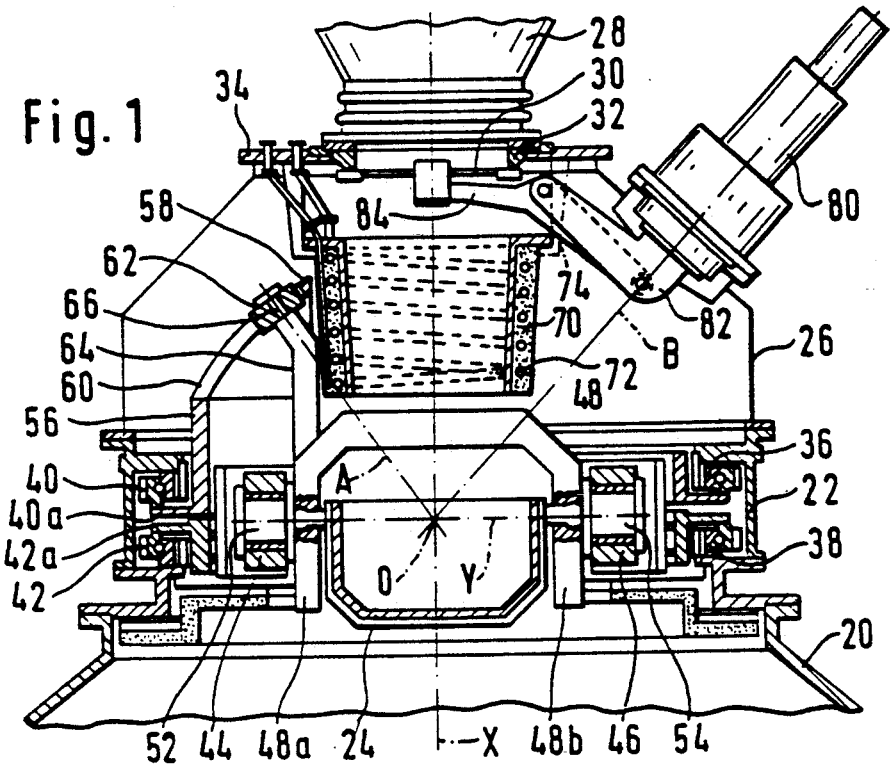
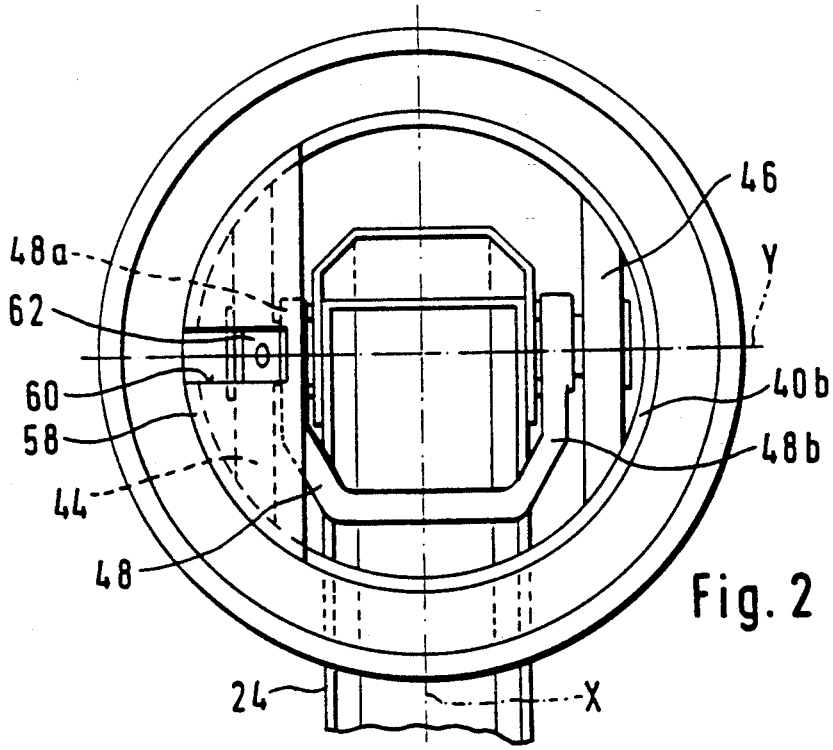
Fig. 2

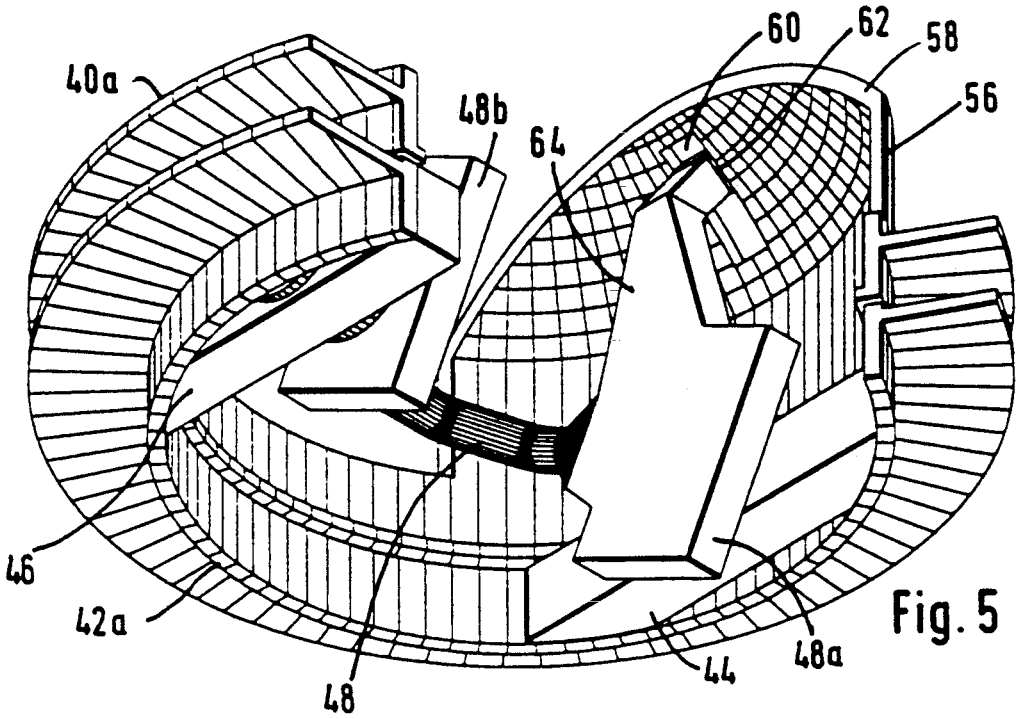
Fig. 5
Fig. 6
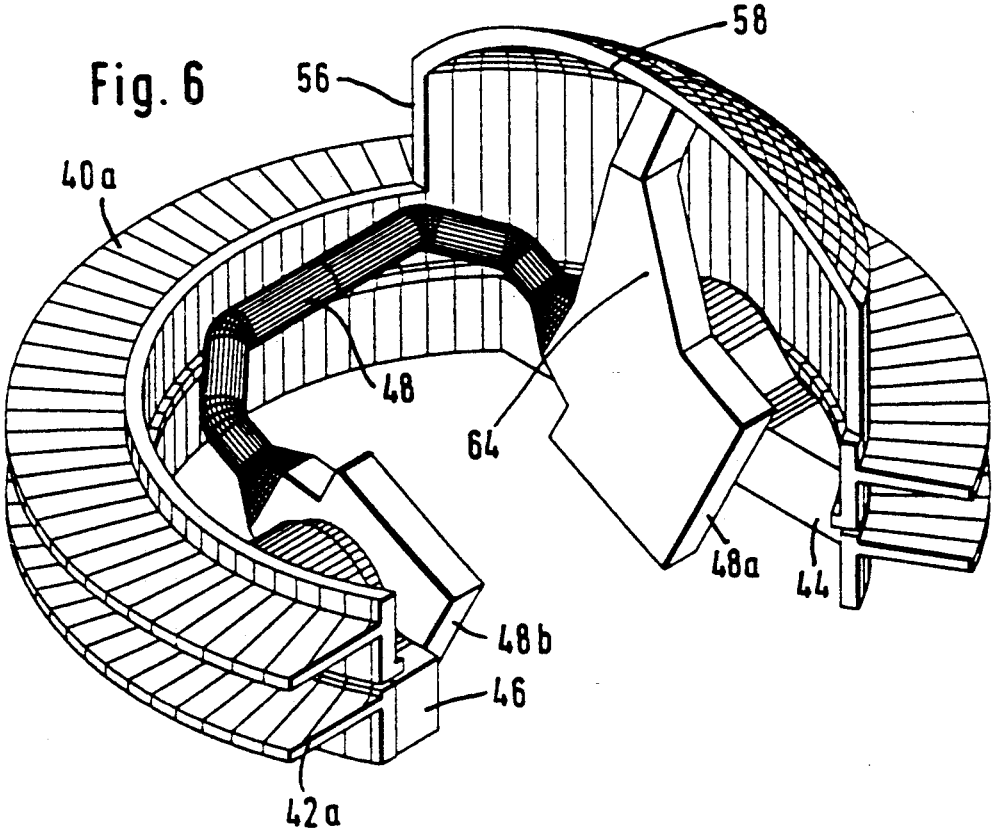

INSTALLATION FOR CHARGING A SHAFT FURNACE

BACKGROUND OF THE INVENTION

The present invention relates to an installation for charging a shaft furnace, comprising a rotating and pivoting distribution chute suspended from the top of the furnace, means for driving the chute, consisting of first and second rolling rings which are designed to cause the chute to rotate about the vertical axis of the furnace and to modify its angle of tilt relative to this axis by pivoting about its horizontal axis of suspension, means for actuating, independently of each other, the two rolling rings, a central hopper equipped with a lower sealing valve, two horizontal crosspieces extending parallel on either side of the chute, inside the second ring of which the crosspieces are securely fastened, the chute being supported in a removable manner by two lateral side plates each comprising a support journal each housed in a bearing of each of the said crosspieces.

A charging installation of this type is known from U.S. Pat. No. 5,022,806, incorporated herein by reference in its entirety. This known installation has, inter alia, the advantage of permitting the removal of its chute via its drive mechanism and of being easily fitted onto existing blast furnaces in order to replace a conventional bell-type charging installation.

SUMMARY OF THE INVENTION

An object of the present invention is to provide an improved charging installation of this type, which is more compact and permits more efficient and reliable transmission of the pivoting forces on the distribution chute, and conversely, a reduction of the stresses on the gears due to the weight of the chute.

In order to attain this objective, the installation proposed by the present invention comprises two side plates consisting of the legs of a "U"-shaped stirrup piece extending transversely relative to the chute, the first ring comprising a dome in the shape of a sector with a spherical surface whose center of curvature is located at the intersection of the vertical axis and of the horizontal axis. Along the meridian of the dome is an elongated groove with parallel edges. One of the side plates extended in the direction of the dome by means of an arm whose end pivots in a runner block sliding in the groove and the pivoting axis between the arm and the runner block, or vice versa, passes via the center of curvature of the dome.

Consequently, when the first rolling ring performs a relative movement with respect to the second rolling ring, either through acceleration or through inversion of the direction of rotation, the dome causes the arm and the stirrup piece to pivot directly about the horizontal axis and this pivoting force is transmitted directly onto the chute. This pivoting of the arm is made possible via the sliding of the runner block in the groove of the dome. Given that the pivoting of the arm is transmitted through a stirrup piece, this force is distributed uniformly over the two axes of suspension of the chute.

The sealing valve which provides the seal between the hopper and the inside of the furnace is preferably actuated by a drive mechanism with axial and rotating movements, known per se. In accordance with the present invention, this drive mechanism is arranged so that its axis passes via the center of curvature of the dome This arrangement makes it possible for overall size to be the minimum necessary for maneuvering the sealing valve, given that the latter, during its opening and closing, performs a circular movement concentric with the dome such that the movement of the dome does not interfere with maneuvering of the sealing valve and vice versa.

According to an advantageous embodiment, a feed tube is suspended below the hopper and penetrates axially into the open cylindrical space created by the rotation of the dome about the vertical axis. This tube is preferably cooled by a cooling coil, with water, passing through the wall of the tube.

The above discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES:

FIG. 1 shows diagrammatically, in vertical section, the charging installation in accordance with the present invention.

FIG. 2 shows a plan view of the installation in FIG. 1.

FIGS. 5 and 6 show two views in perspective, from different angles, of the suspension stirrup piece of the chute and of its maneuvering dome.

DESCRIPTION OF THE PREFERRED EMBOIDMENT

Figure 3:
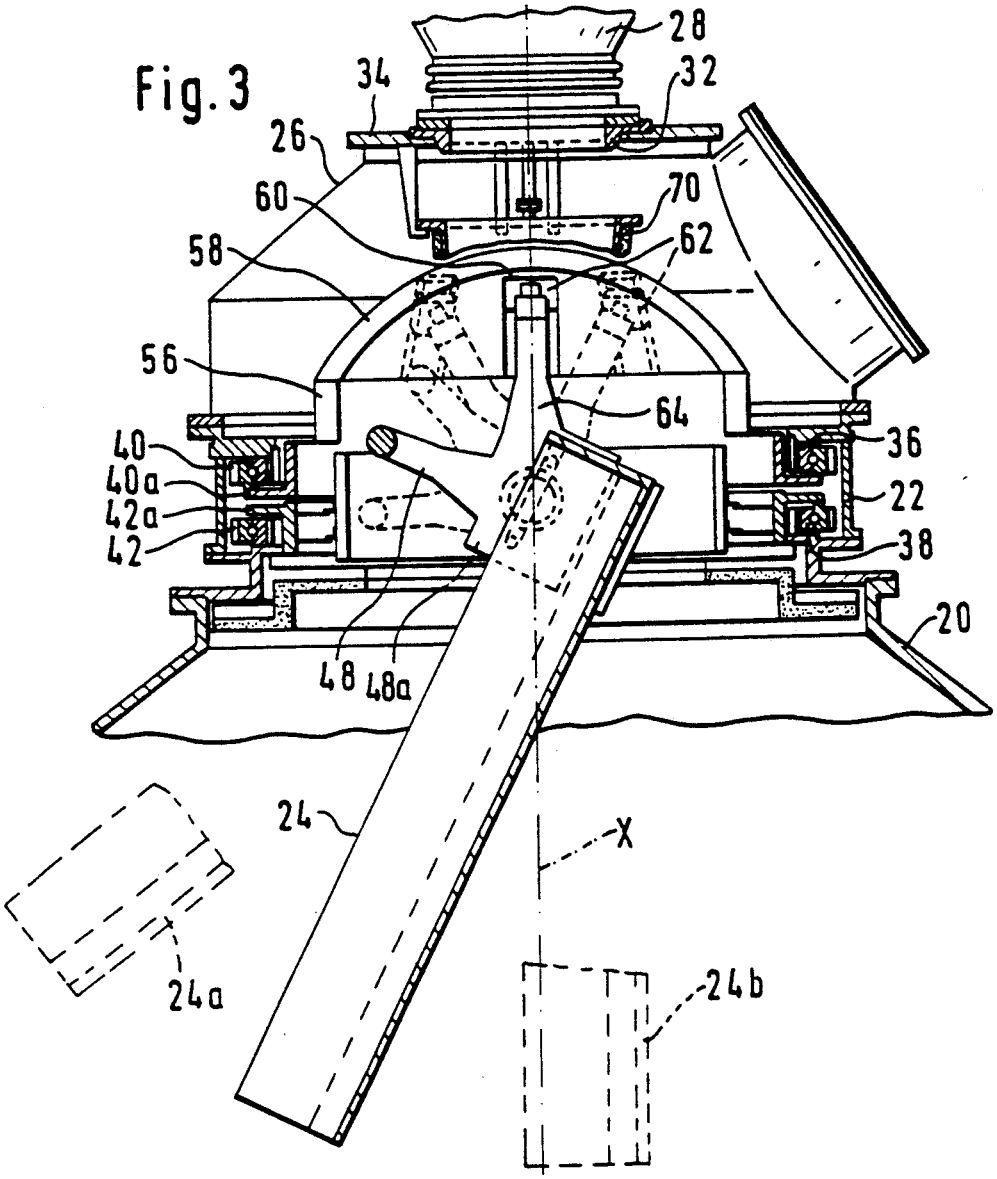
FIG. 3 shows a view in a sectional plane perpendicular to that of FIG. 1.

Reference will first be made to FIGS. 1 to 3 in order to give a brief description of the components parts of the installation proposed by the present invention. Reference 20 shows, on FIGS. 1 and 3, the top of a blast furnace, on the upper flange of which is fastened a housing 22 containing a drive mechanism of a distribution chute 24 for causing the latter to rotate about the vertical central axis X and in order to modify its tilt relative to this axis by pivoting about its horizontal axis of suspension Y. A casing 26 which is in turn beneath a central feed hopper 28 is located above the housing 22. This hopper can be isolated from the casing 26 by a sealing valve 30 interacting with an annular seat 32 fastened on a flange 34 between the casing 26 and the hopper 28.

The drive mechanism of the chute 24 essentially comprises a first and a second rolling group consisting, respectively, of two hoops 36, 38 securely fastened to the wall of the housing 22 and of two toothed rolling rings 40, 42 revolving around the hoops 36 and 38 by means of known rolling means such as balls or rollers. The two toothed rings 40, 42 are actuated independently by pinions, which are not shown, and which form part of a drive system which makes it possible either to cause the two rings 40, 42 to rotate synchronously, or to delay or to accelerate the ring 40 relative to the ring 42.

Each of the two rings 40, 42 comprises an annular support profile 40*a*, 42*a*, respectively, arranged coaxially one above the other. Two parallel horizontal crosspieces 44, 46 are welded inside the support profile 42*a* of the lower ring 42 at a sufficient distance from the central axis X so as to permit suspension of the chute 24. This chute 24 is suspended by means of lateral side plates 48*a*, 48*b*, each of these side plates being provided with an outer journal 52, 54 supported, in a pivoting manner, in bearings provided in each of the crosspieces 44, 46. The tilt of the chute 24 relative to the vertical axis X may thus be modified by pivoting the journals 52, 54 about their horizontal axis of suspension Y in the crosspieces 44, 46.

The description given above of the suspension and the driving of the distribution chute 24 corresponds exactly to the installation in accordance with U.S. Pat. No. 5,022,806. However, the installation of the present invention differs from the known installation in that it translates the movement of the rolling ring 40 to the pivoting of the chute 24 about its horizontal axis of suspension Y. Unlike the known installation, the two lateral side plates 48*a*, 48*b* are not independent side plates but, in fact, form the legs of a "U"-shaped stirrup piece 48 extending transversely relative the chute 24 (see also FIGS. 5 and 6). This design already offers the advantage of it being possible to remove the stirrup piece 48 en bloc with the side plates 48*a* and 48*b* after removing the chute 24. It is thus unnecessary, as in the known installation, to remove the side plates separately and, moreover, there is no need to set and fasten the position of one side plate relative to the other.

As shown in FIGS. 5 and 6, the annular profile 40*a* of the toothed ring 40 has, over an arc of approximately 120°, a cylindrical sector 56 extending upwards as far as the inside of the casing 26. This cylindrical sector 56 is topped by a dome 58 in the form of a sector with a spherical surface whose center of curvature O is located at the intersection of the vertical axis X and of the horizontal pivoting axis Y of the chute 24. This dome 58 comprises an elongated groove 60 or cutout, with parallel edges, whose longitudinal axis extends along a meridian of the spherical surface of the dome 58. This groove 60 is used for the guiding and the sliding of a runner block 62 provided at the end of a lever 64 which is securely fastened to the stirrup piece 48 and which can be formed by the extension of one of the side plates 48*a* or 48*b*. The end of this lever arm 64 is designed in the form of a journal 66 on which the runner block 62 is accommodated so that the latter can pivot relative to the lever arm 64, and vice versa, about the axis A of the journal. This pivoting axis A is oriented, according to one of the features of the invention, so as to pass via the center of curvature O of the dome 58. In the example shown, the runner block 62 slides simply in the groove 60 by rubbing along the walls. In order to improve this sliding, it is possible to equip the runner block 62 with a rolling system.

When the two rolling rings 40, 42 are actuated in synchronism, at the same angular speed, the distribution chute 24 rotates about the vertical axis X with a constant tilt in order to deposit the charging material in circles on the charging surface On the other hand, if, through the action of a planetary drive mechanism, the rolling ring 40 performs a relative movement with respect to the speed of rotation of the ring 42, the dome 58 acts on the lever arm 64 by causing the stirrup piece 48 to pivot about the horizontal axis Y in order to modify the tilt of the chute 24 relative to the vertical axi X. This pivoting of the lever arm 64 is accompanied by a sliding of the runner block 62 in the groove 60.

In theory, it is possible to reduce the length of the arc of the dome and, in the extreme case, to reduce it to the presence of a spherical arm necessary for the definition of the groove. In practice, it is, nevertheless, preferable to widen the dome, for example up to approximately 120°, as shown in the example, in order to have a better distribution of forces over the profile 40*a*.

Figure 4:
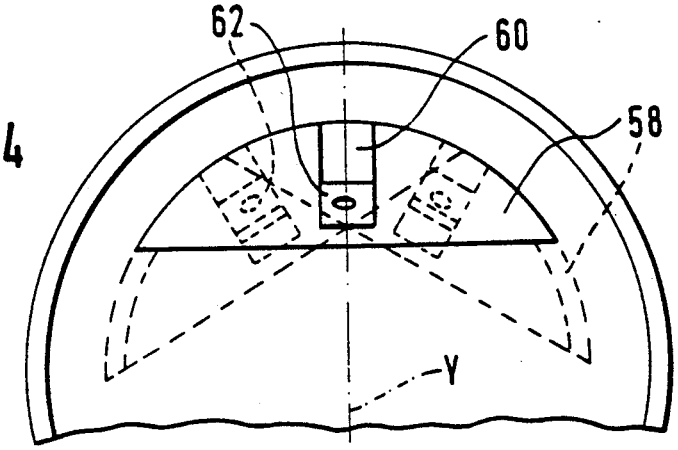
FIG. 4 illustrates diagrammatically the pivoting of the arm following the movement of the dome.

FIGS. 3 and 4 illustrate diagrammatically three different angular positions of the chute 24 through the action of the dome 58. The position shown in solid lines is an average position corresponding to a vertical orientation of the lever arm 64, in which the runner block 62 is located in its highest position in the groove 60. The positions 24*a* and 24*b* of the chute shown in broken lines correspond, respectively, to the maximum and minimum tilts of the chute, the latter being the vertical position. As shown in FIGS. 3 and 4, these extreme tilts are obtained starting with the average tilt through relative rotation of the dome 58 with respect to the rolling ring 42, either in one direction or in the opposite direction, and are accompanied by a descent of the runner block 62 in the groove 60 of the dome 58. As confirmed in FIG. 4, the amplitude of rotation of the dome 58 necessary for the pivoting of the chute 24 from the vertical position toward that 24*a* of maximum tilt is less than ¼ of a revolution.

By virtue of the stirrup piece 48, the moment of the lever arm 64 is distributed uniformly over the two journals 52 and 54 which, compared with the case in which the chute is actuated only on one side, eliminates the overturning moments on the journals. Given that the lever arm 64 may be relatively long, the transmission ratio of the forces is all the more favorable. The length of this arm 64 depends, moreover, on the height of the sector 56. Furthermore, compared with known mechanisms, that proposed by the present invention offers the advantage that the pivoting force of the chute always acts perpendicularly to the arm 64 regardless of the tilt of the chute.

In the embodiment illustrated in the FIGURES, the stirrup piece 48 passes above the chute 24. It is, however, possible, to arrange the stirrup piece so that it is oriented in the opposite direction, that is to say it passes below the chute 24. In this case, it may be designed in the form of a cradle for the upper end of the chute 24.

Figure 7:
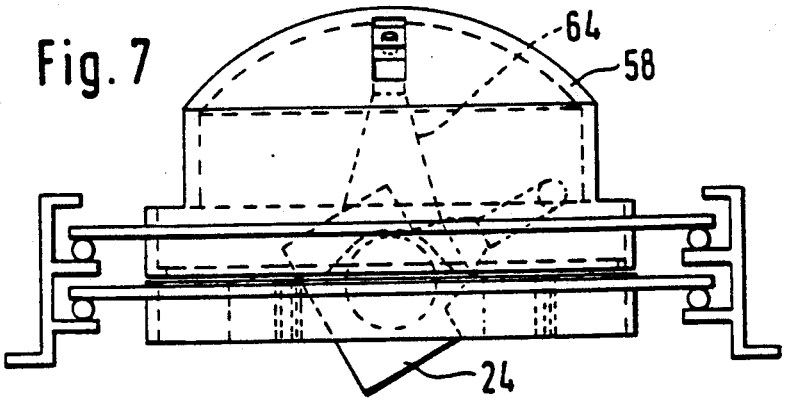
FIGS. 7, 8, 9, 10 and 11 show diagrammatically five different tilts produced through the action of the cupola part; and FIGS. *7a*, *8a* and *11a* show, on a larger scale, the details of the movement of the runner block in the groove of the cupola piece.
Figure 7A:
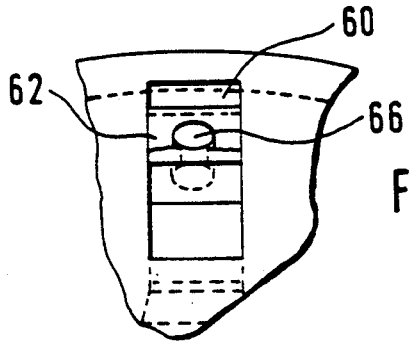

A description will now be given in greater detail, with reference to FIGS. 7 to 11, of the pivoting of the chute 24 about its axis of suspension Y, through the effect of a relative movement of the ring 40 with respect to the ring 42. FIG. 7 shows an average tilt of the chute 24, corresponding to the tilt shown in solid lines in FIG. 3. In this position, the lever arm 64 occupies its vertical position, the runner block 62 being, therefore, automatically at the top of its travel in the groove 60. When the dome 58 is turned through an angle $\alpha$, in the direction of FIG. 8, through the effect of a relative rotation of the ring 40 relative to the ring 42, the lever arm 64 is pivoted in the direction of a raising of the chute 24, that is to say towards an increase in the tilt relative to the vertical axis X. This movement is necessarily accompanied by a descent of the runner block 62 in the groove 60 of the cupola part 58, which is illustrated by FIG. 8*a*.

Figure 9:
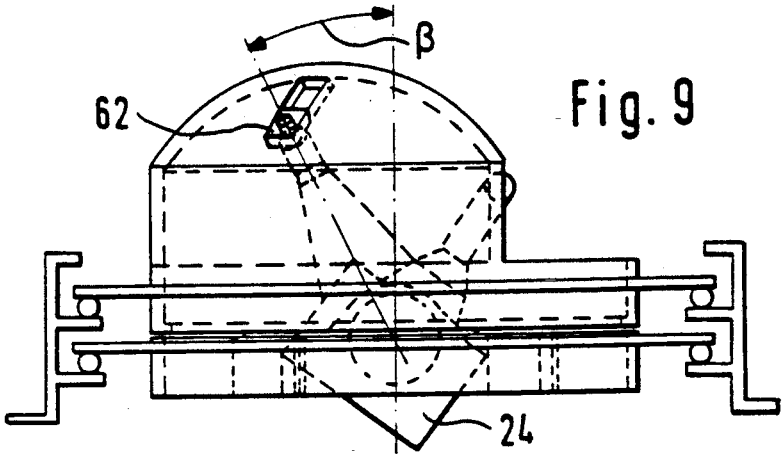

If the dome 58 continues the relative movement in the same direction the position according to FIG. 9 is approached, this FIGURE illustrating the maximum angular offset $\beta$ of the dome 58, corresponding to a maximum tilt of the chute 24, for which the runner block 62 is positioned at the bottom of the groove 60.

Figure 8:
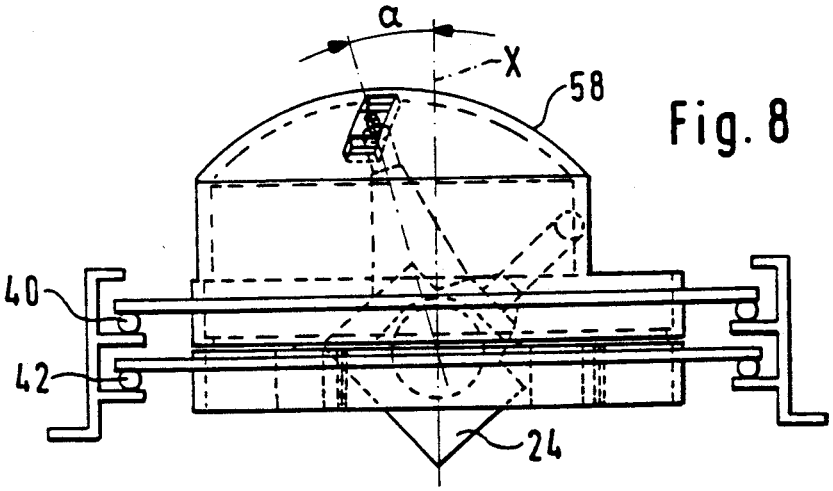
Figure 8A:
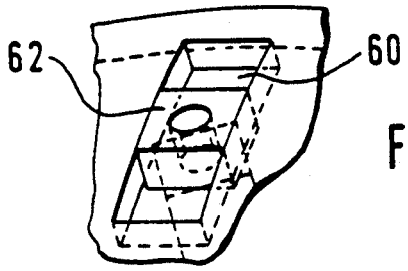
Figure 10:
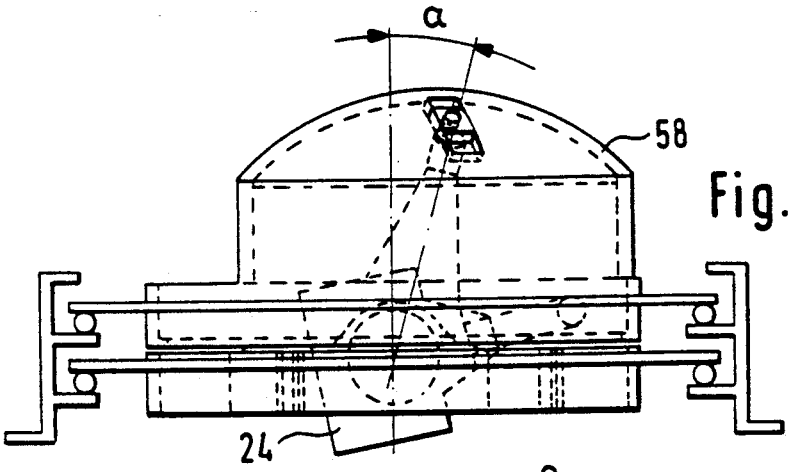
Figure 11:
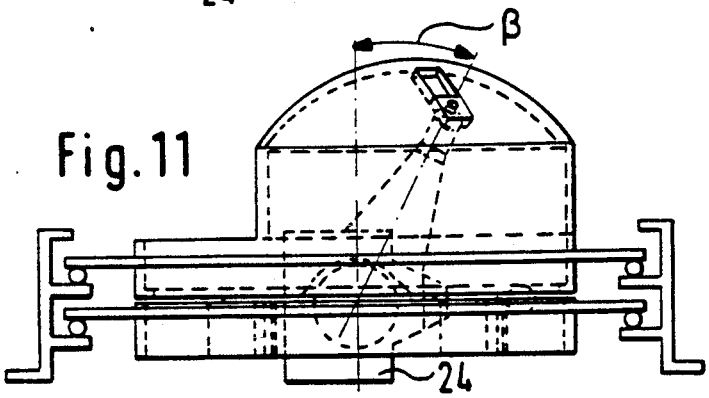
Figure 11A:
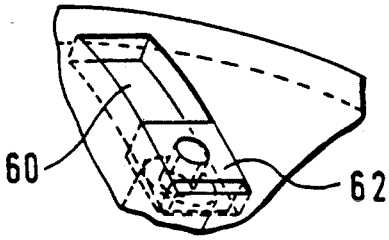

When, on the basis of the positions according to FIG. 7, the dome 58 is turned through an angle $\alpha$ in the direction opposite to that in FIG. 8, the symmetrical situation, relative to FIG. 7, is again arrived at, as illustrated in FIG. 10. The tilt of the chute 24 is thus reduced relative to the vertical axis X, while the runner block 62 occupies the same position in the groove 60 as in the position in FIG. 8*a*. Continuing the rotation of the dome 58 towards the maximum angular offset of an angle $\beta$ lowers the chute 24 into the vertical position according to FIG. 11. In this position, the runner block 62 is, once again, as shown in FIG. 11*a*, at the bottom of the groove 60, in the same position as that which it occupies in FIG. 9.

FIG. 1 will now be examined again in order to illustrate the advantageous possibilities offered by the drive device proposed by the present invention. During rotation of the chute 24 about the vertical axis X, the horizontal overall dimension of the dome 58 corresponds substantially to an annular surface equivalent to the projection of the dome 58 in a horizontal plane. In other words, a cylindrical space remains available at the center for installing therein a feed tube 70 guiding the dropping of the charging material onto the chute 24. This tube 70 may be simply laced on a support hoop 74 securely fastened to the flange 34. Thus tube is preferably water-cooled, by virtue of a cooling coil 72 embedded in a layer of heat-conducting concrete applied around the wall of the tube. In addition to its direct action on the wall of the tube, this cooling, amongst other things, protects the loose joint of the valve against thermal radiation.

A further advantage is offered by the possibility of using a sealing valve as proposed in U.S. Pat. No. 4,755,095, incorporated herein by reference in its entirety. This document proposes a valve carried by a maneuvering arm actuated by a mechanism with axial and rotary movement and whose axis is tilted relative to the axis of the seat of the valve. Reference 80 denotes such a maneuvering mechanism of the sealing valve 30. This mechanism is fastened on the wall of the casing 26. The maneuvering arm of the valve 30 consists of a fork 82 which can be set in rotation by the drive mechanism 80 about is maneuvering axis B. The sealing valve 30 is carried by the end of a lever arm 84 pivoting about the end of the fork 82, the other end of the lever arm 84 being actuated in the axial direction by the mechanism 80 in order to cause the lever 84 to pivot about its point of fastening to the fork 82. Opening of the sealing valve 30 firstly comprises an axial movement of the mechanism 80 in order to cause the lever 84 to pivot in an anti-clockwise direction in order to disengage the valve 30 by a rotary movement towards a waiting position. Closure of the valve naturally comprises the same stages in reverse By orienting the drive mechanism of the valve 30 so that its axis B of rotation of the fork 82 passes via the center O of the dome 58, the sealing valve 30 moves, during its maneuvering, along a circular curve which is concentric with the dome 58. In other words, in the waiting position, the valve 30 can occupy the very confined space between the dome 58 and the wall of the casing 26 while, during its maneuvering, it can also move in this space without the valve 30 impeding the movement of the dome 58 of vice versa.

The design of the charging installation according to the present invention does not exclude other advantageous embodiments described in U.S. Pat. No. 5,022,806. For example, the cooling system of the suspension of the chute and of its drive mechanism can be fitted without modifications to the installation according to the present invention. Similarly, despite the presence of the stirrup piece 48 according to the present invention, it is possible to provide a detachable hooking device for the chute as in the above-mentioned document While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. An installation device for charging a shaft furnace, comprising a distribution chute suspended from a top of the furnace, said distribution chute being rotatable about a vertical x axis of the furnace and pivotable about a horizontal y axis of suspension of said chute;

means for driving said chute, said means for driving said chute comprising first and second independently actuated rolling rings for rotating said chute about the x axis and for modifying an angle of tilt of said chute relative to the x axis by pivoting about the y axis, said first rolling ring includes a curved element having a center of curvature O being located at the intersection of the x axis and the Y axis, said first rolling ring having an elongated groove with generally parallel edges extending along a meridian of said curved element;

two generally horizontal crosspieces extending generally parallel on one side of said chute, said crosspieces being securely fastened to said second rolling ring; each of said crosspieces including a bearing;

a U-shaped stirrup member extending transversely to said chute, said stirrup member having two lateral side plates which form legs of said U-shape, said chute being supported in a removable manner by said two lateral side plates, each of said lateral side plates including a support journal housed in said corresponding bearing of each of said crosspieces;

an arm extending from one of said lateral side plates in a direction of said curved element; and a runner block wherein one end of said arm pivots, said runner block sliding in said groove, wherein a pivoting axis A defined between said arm and said runner block passes the center of curvature O of said curved element.

2. The device of claim 1 wherein said curved element comprises:

a dome having the shape of a sector with a spherical surface extending horizontally over an arc of about 120°.

3. The device of claim 2 wherein said dome covers a cylindrical sector securely fastened to an annular support profile of said first rolling ring.

4. The device of claim 1 further comprising: a sealing valve being actuated by a drive mechanism with axial and rotary movement and with an axis of rotation B passing through the center of curvature O of said curved element.

5. The device of claim 1 further comprising:

a central hopper disposed above said distribution chute; and a feed tube suspended below said central hopper, said feed tube penetrating axially into an open cylindrical space created by the rotation of said curved element about the x axis.

6. The device of claim 5 further comprising:

a cooling coil passing through the wall of said feed tube.

* * * * *